US005401392A

United States Patent [19]

Courty et al.

[11] Patent Number: 5,401,392

[45] Date of Patent: Mar. 28, 1995

[54] PROCESS FOR ELIMINATING MERCURY AND POSSIBLY ARSENIC IN HYDROCARBONS

[75] Inventors: Philippe Courty, Houilles; Pierre Dufresne, Rueil Malmaison; Jean P. Boitiaux; Germain Martino, both of Poissy, all of France

[73] Assignee: Institut Francais du Petrole, Rueil Malmaison, France

[21] Appl. No.: 148,543

[22] Filed: Nov. 8, 1993

Related U.S. Application Data

[63] Continuation of Ser. No. 761,797, Sep. 16, 1991, abandoned.

[30] Foreign Application Priority Data

Mar. 16, 1989 [FR] France ..... 89 03581

[51] Int. Cl.[6] ..... C10G 45/08; C10G 25/00

[52] U.S. Cl. ..... 208/251 H; 208/251 R; 208/253; 208/293; 208/295; 208/301; 208/302; 208/303; 585/823; 585/843; 585/845; 585/850

[58] Field of Search ..... 208/251 R, 251 H, 253, 208/293, 295, 301, 302, 303; 585/823, 843, 845, 850

[56] References Cited

U.S. PATENT DOCUMENTS

| | | | |
|---|---|---|---|
| 2,905,625 | 9/1959 | Berger | 208/89 |
| 3,069,350 | 12/1962 | Ramella | 208/89 |
| 3,110,569 | 11/1963 | Carter | 208/251 R |
| 3,804,750 | 4/1974 | Myers et al. | 208/253 |
| 3,876,533 | 4/1975 | Myers | 208/251 R |
| 4,046,674 | 9/1977 | Young | 208/251 H |
| 4,069,140 | 1/1978 | Wunderlich | 208/251 H |
| 4,474,896 | 10/1984 | Chao | 502/216 |
| 4,549,957 | 10/1985 | Hensley, Jr. et al. | 208/216 PP |
| 4,551,237 | 11/1985 | Fenton | 208/251 R |
| 4,709,118 | 11/1987 | Yan | 585/820 |
| 4,839,029 | 6/1989 | Ichikawa | 208/251 R |
| 4,911,825 | 3/1990 | Roussel et al. | 208/251 R |
| 4,966,684 | 10/1990 | Audeh | 208/251 H |

*Primary Examiner*—Helen M. S. Sneed
*Assistant Examiner*—Walter D. Griffin
*Attorney, Agent, or Firm*—Millen, White, Zelano & Branigan

[57] ABSTRACT

For removing mercury and any arsenic in hydrocarbon charges containing mercury and sulfur, the charge is contacted with an arsenic collecting material having catalytic properties ("catalyst") in hydrogen, the material containing at least one metal selected from the group consisting of nickel, cobalt, iron, palladium, and platinum; at least one metal selected from the group consisting of chromium, molybdenum, tungsten, and uranium; and an active phase carrier. Downstream of the catalyst or mixed therewith is a mercury collecting material containing a sulfide of at least one metal selected from the group consisting of copper, iron, and silver or sulfur, and an active phase carrier.

24 Claims, No Drawings

PROCESS FOR ELIMINATING MERCURY AND POSSIBLY ARSENIC IN HYDROCARBONS

This application is a continuation of application Ser. No. 07/761,797, filed Sep. 16, 1991, abandoned.

BACKGROUND OF THE INVENTION

It is known that by-product liquid condensates from the production of gas (natural gas, associated gas) and crude oil can contain many trace metal compounds in the trace state, generally present in the form of organometallic complexes, in which the metal forms bonds with one or more carbon atoms of the organometallic radical.

These metal compounds are poisons of catalysts used in the processes of transformation of petroleum. In particular, they poison the catalysts of hydrofining and hydrogenation by gradually being deposited on the active surface. Metal compounds are located in particular in the heavy cuts coming from the distillation of crude (nickel, vanadium, arsenic, mercury) or else in natural gas condensates (mercury, arsenic).

The thermal cracking or catalytic processing of the above hydrocarbon cuts, for example, their steam cracking for conversion into lighter hydrocarbon cuts, can make possible the elimination of some metals (for example, nickel, vanadium . . . ); on the other hand, some other metals (for example, mercury, arsenic . . . ) able to form volatile compounds and/or being volatile in the element state (mercury) are at least partly in the lighter cuts and can thereby poison the catalysts of the subsequent transformation processes. The mercury further presents the risk of causing corrosions by forming amalgams, for example, with the alloys with an aluminum base, in particular in the sections of the processes operating at a sufficiently low temperature to cause the condensation of liquid mercury (cryogenic fractionations, exchangers).

Prior processes are known for eliminating mercury or arsenic in gas phase hydrocarbons; the procedure is performed in particular in the presence of solid masses, which can equally be called: adsorption, collection, trapping, extraction, metal transfer masses.

Concerning the masses for demercurization: U.S. Pat. No. 3,194,629 describes masses consisting of sulfur or else iodine deposited on activated carbon.

U.S. Pat. No. 4,094,777 of the applicant describes other masses comprising copper at least partly in the form of sulfide and a mineral support. These masses can also contain silver.

French application 87-07442 of the applicant describes a specific method of preparation of said masses.

Patent FR 2534826 describes other masses consisting of elementary sulfur and a mineral support.

Concerning the dearsenification:

Patent DE 2149993 teaches the use of metals of group VIII (nickel, platinum, palladium).

U.S. Pat. No. 4,069,140 describes the use of various absorbent masses. Supported iron oxide is described, the use of lead oxide is described in U.S. Pat. No. 3,782,076 and that of copper oxide in U.S. Pat. No. 3,812,653.

Now, if some of the products described in the prior art exhibit good performances for the demercurization or else for the dearsenification of gas (for example, hydrogen) or gas mixtures (for example, natural gas) and more particularly when the natural gas contains a large amount of hydrocarbons containing three or more than three carbon atoms, the tests made by the applicant show that the same products prove not very effective as soon as the batches contain compounds other than elementary metals, for example, for arsenic, arsines comprising chains containing hydrocarbon containing two or more than two carbon atoms or else, for mercury, dimethyl mercury and other mercury compounds comprising chains containing hydrocarbon containing two or more than two carbon atoms, and optionally other nonmetal elements (sulfur, nitrogen . . . ).

Further, other tests carried out by the applicant show that when sulfur is present in the batch, it can interact with active metal elements for the dearsenification which, then at least partly transformed into sulfides, can then present a significant loss of activity.

The object of the invention is a process of eliminating mercury and optionally arsenic contained in a batch containing hydrocarbon and which eliminates defects of the prior processes.

Another object of the invention is to be able to eliminate mercury and optionally arsenic even in batches containing hydrocarbon further containing significant proportions of sulfur. By significant proportions, 0.005 to 3% by weight, and in particular 0.02 to 2% by weight, is meant.

According to the process of the invention, a mixture of the batch and hydrogen is made to pass in contact with a catalyst that below will arbitrarily be called arsenic collection mass, with catalytic properties, containing:

- at least one metal M of the group formed by iron, cobalt, nickel, palladium and platinum;
- at least one metal N of the group formed by chromium, molybdenum, tungsten and uranium;
- and optionally an active phase support, with a base of at least one porous mineral matrix, said catalyst being followed on the path of the batch of, or mixed with, a mercury collection mass, containing sulfur and/or at least one metal sulfide with at least one metal P selected from the group formed by copper, iron and silver, and an active phase support.

According to another embodiment of the invention, it is also possible to add a sulfur compound; for example, an organic sulfide or else hydrogen sulfide, either in the crude batch (before dearsenification), or in the batch treated in the presence of hydrogen and the dearsenification mass with catalytic properties, before demercurization in the presence of the second bed.

When the batch also contains arsenic, the latter is also eliminated. The procedure is performed preferably with the batch at least partly in liquid phase.

It has also been discovered, in a surprising way, that in the presence of high concentrations of arsenic or else in the presence of high "liquid" hourly volumetric rates able to cause an imperfect collection of arsenic (for example, less than 90%) on the arsenic collection mass with catalytic properties, the mercury collection mass also operates in a very satisfactory manner for the collection of arsenic.

Finally, it has been discovered that, in a surprising manner, the catalyst also makes possible a hydrodesulfuration, a hydrodenitrification and, at least partly, a hydrogenation of unsaturated compounds able to be located in the batch, which can prove advantageous when said batches are intended for steam cracking. Finally, said mass makes possible an effective demetallization if, besides arsenic and mercury, vanadium and/or nickel are present.

In a surprising way, the catalytic properties of said arsenic collection mass remain unchanged, even in the case of the strict absence of said metal in the batch.

Said arsenic collection mass with catalytic properties is therefore a complex solid, which, in the presence of hydrogen and under the operating conditions described below:

activates by catalysis the compounds of mercury and arsenic (if arsenic is present) and transforms them into reactive compounds relative to collection masses, object of the invention, selectively collects arsenic (if arsenic is present), activates by catalysis said mercury compounds even in the strict absence of arsenic compounds.

The arsenic collection mass with catalytic properties designated below as "the catalyst" entering into the composition of the whole being the object of this invention therefore consists of at least one metal M selected from the group formed by iron, nickel, cobalt, palladium, platinum and at least one metal N selected from the group formed by chromium, molybdenum, tungsten and uranium, these metals, in the form of oxides and/or oxysulfides and/or sulfides, able to be used just as they are or preferably to be deposited on at least one support of the following list. Under conditions of use, it is imperative that metal M and/or metal N are in sulfurated form for at least 50% of their whole.

It is known to one skilled in the art that the state of equilibrium between the reduced and sulfurated forms depends, among others, on the operating conditions and in particular, besides the temperature, on partial pressures of hydrogen, hydrogen sulfide, and steam in the reaction medium, e.g.:

$$CoO + H_2 \rightleftarrows Co + H_2O \qquad (Kp)_T = \frac{p \cdot H_2O}{p \cdot H_2}$$

$$9Co + 8H_2S \rightleftarrows Co_9S_8 + 8\,H_2 \qquad (K'p)_T = \frac{p \cdot H_2}{p \cdot H_2S}$$

The respective amounts of metal or metals M and metal or metals N contained in the catalyst are usually such that the atomic ratio of metal or metals M to metal or metals N, M/N, is about 0.3:1 to 0.7:1 and preferably about 0.3:1 to about 0.45:1.

The amount by weight of metals contained in the finished catalyst expressed by weight of metal relative to the weight of the finished catalyst is usually about 2 to 30% and preferably about 5 to 25% for metal or metals N, and about 0.01 to 15%, more particularly about 0.01 to 5% for metal or metals M and preferably about 0.05 to 3% for palladium and/or platinum; and about 0.5 to 15% and preferably about 1 to 10% in the case of nonnoble metals M (Fe, Ca, Ni).

Of metals N, molybdenum and/or tungsten are preferably used, and of metals M, nonnoble metals iron, cobalt and/or nickel are preferably used. Advantageously, the following metal associations are used: nickel-molybdenum, nickel-tungsten, cobalt-molybdenum, cobalt-tungsten, iron-molybdenum and iron-tungsten. The most preferred associations are nickel-molybdenum and cobalt-molybdenum. It is also possible to use associations of three metals, for example, nickel-cobalt-molybdenum.

The porous mineral matrix is selected so that the final catalyst has optimum pore volume characteristics. This matrix usually comprises at least one of the elements of the group formed by alumina, silica, silica-alumina, magnesia, zirconia, titanium oxide, clays, aluminous cements, aluminates, for example, magnesium, calcium, strontium, barium, manganese, iron, cobalt, nickel, copper and zinc aluminates, mixed aluminates, for example, those comprising at least two of the metals cited above.

It is possible to prefer to use matrices containing alumina, for example, alumina and silica-alumina or else titanium oxide. When the matrix contains silica, it is preferable that the amount of silica be at most equal to 25% by weight relative to the total weight of the matrix.

In addition, the matrix can also contain at least one of the compounds cited above, at least one crystalline, zeolite aluminosilicate, synthetic or natural (zeolite). The amount of zeolite usually represents 0 to 95% by weight and preferably 1 to 80% by weight relative to the weight of the matrix.

It is also possible to use advantageously mixtures of alumina and zeolite or else mixtures of silica-alumina and zeolite.

Of the zeolites, it is usually preferred to use zeolites whose skeleton atomic ratio, silicon to aluminum (Si/Al), is greater than about 5:1. Zeolites with faujasite structures and in particular Y stabilized or ultrastabilized zeolites are advantageously used.

The most commonly used matrix is alumina, and transition and pure aluminas or aluminas in a mixture, such as $\gamma_C$, $\gamma_T$, $\delta$, $\theta$, are usually preferred.

Said matrix will preferably exhibit a large surface and a sufficient pore volume, i.e., or at least 50 $m^2/g$ and at least 0.5 $cm^3/g$, for example, 50 to 350 $m^2/g$ and 0.5 to 1.2 $cm^3/g$. The macropore volume fraction, consisting of all the pores of an average diameter at least equal to 0.1 micron, can represent 10% to 30% of the total pore volume.

The preparation of such a catalyst is sufficiently known to one skilled in the art not to be repeated in the context of this invention.

Before use, the catalyst can, if necessary, be treated by a gas containing hydrogen at a temperature of 50° to 500° C. It can also, if necessary, be presulfurated at least partly, for example, according to the French SULFICAT (R) process or else by treatment in the presence of a gas containing hydrogen sulfide and/or any other sulfur compound.

The mercury collection mass entering into the composition of the whole being the object of this invention consists of sulfur or a sulfur compound deposited on a support or porous mineral matrix selected, for example, from the group formed by alumina, silica-aluminas, silica, zeolites, clays, activated carbon, aluminous cements, titanium oxides, zirconium oxide or else from the other supports, consisting of a porous mineral matrix, cited for the catalyst.

It is possible to use, as collection mass, sulfur deposited on a support and, for example, a commercial product such as CALGON HGR, and more generally any product consisting of sulfur deposited on activated carbon or on a macroporous alumina as described in French patent 2534826.

A compound containing sulfur and a metal P, where P is selected from the group formed by copper, iron, silver and, preferably, by copper or the copper-silver association, will preferably be used. At least 50% of metal P is used in the form of sulfide.

This collection mass can be prepared according to the method recommended in U.S. Pat. No. 4,094,777 of the applicant or else by deposition of copper oxide on an alumina then sulfuration by an organic polysulfide as described in French patent application 87/07442 of the applicant.

The proportion of elementary sulfur combined or not in the collection mass is advantageously between 1 and 40% and preferably between 1 and 20% by weight.

The proportion of metal P combined or not in the form of sulfide will preferably be between 0.1 and 20% of the total weight of the collection mass.

The whole consisting of the catalyst and the mercury collection mass can be used either in two reactors or in a single one.

When two reactors are used, they can be placed in series, the reactor containing the catalyst being advantageously placed before the one containing the collection mass.

When a single reactor is used, the catalyst and the collection mass can be placed either in two separate beds or intimately mixed.

According to the amounts of mercury and/or arsenic (calculated in elementary form) contained in the batch, the volume ratio of the dearsenification mass with catalytic properties to the demercurization mass can vary between 1:10 and 5:1.

When the procedure is performed in separate reactors, the reactor containing the dearsenification mass with catalytic properties can be operated in a temperature range able to go from 180° to 450° C., more advantageously from 230° to 420° C. and preferably from 260° to 390° C.

The operating pressures will preferably be selected from 1 to 50 absolute bars, more particularly from 5 to 40 bars and more advantageously from 10 to 30 bars.

The hydrogen flow, expressed in liters of gaseous hydrogen (STP) per liter of liquid batch will preferably be selected between 1 and 1000, more particularly between 10 and 300 and more advantageously from 30 to 200.

The hourly volumetric rate, calculated relative to the dearsenification mass with catalytic properties, can be from 0.1 to 30 hours$^{-1}$, more particularly from 0.5 to 20 hours$^{-1}$ and preferably from 1 to 10 hours$^{-1}$ (volumes of liquid, per volume of mass and per hour).

The demercurization mass will be operated in a temperature range able to go from 0° to 400° C., more advantageously from 20° to 350° C. and preferably from 40° to 330° C.

The operating pressures and hydrogen flow D will be those defined relative to the dearsenification mass with catalytic properties.

The hourly volumetric rate, calculated relative to the demercurization mass, can be that indicated for the dearsenification mass with catalytic properties, it being understood, as indicated above, that the volume ratio of the dearsenification mass to the demercurization mass can vary from 1:10 to 5:1 as a function in particular of the proportions of arsenic and mercury contained in the batch. Therefore, of course, the relative proportions of the two masses and therefore the hourly volumetric rates relative to the masses can then be very different (same liquid flow but different mass volumes).

In an embodiment of the invention, the batch treated in the presence of the catalyst can optionally be cooled before passing over the demercurization mass.

In another embodiment, the two collection masses then being placed in a single reactor, the latter can be operated in a temperature range able to go from 180° to 400° C., more advantageously 190° to 350° C. and preferably 200° to 330° C.

Finally, as it is known to one skilled in the art, it can prove advantageous to recycle at the head, at least partly, the hydrogen-rich gas recovered after separation of the purified liquid product. Besides a large reduction of the hydrogen consumption, said recycling makes possible a better control of the ratio of partial pressures $pH_2S/pH_2$ in the reaction medium. As indicated above, for the case where the batch contains very little sulfur (for example, less than 20 ppm by weight), it can further prove advantageous to add in the batch and/or in the hydrogen at least one sulfur compound to increase said ratio $pH_2S/pH_2$.

The batches to which the invention applies more particularly contain $10^{-3}$ to 2 milligrams of mercury per kilogram of batch and, optionally, $10^{-2}$ to 10 milligrams of arsenic per kilogram of batch.

The following examples make it possible to illustrate the various aspects of the invention without limiting its scope. It is obvious for one skilled in the art, considering the examples, that if the dearsenification mass by itself is sufficient to treat batches containing only arsenic, it is necessary, on the other hand, to use the demercurization mass and the dearsenification mass with catalytic properties to demercurize effectively batches containing only mercury. Comparative tests identical with the series of examples 1 to 4 have been conducted in the absence of arsenic in the batch; they have led to similar results.

Example 1 (Comparison)

250 cm$^3$ of catalyst HR 306, produced by PROCATALYSE, is charged in a steel reactor with a 3 cm diameter.

Said catalyst HR 306, consisting of extrudates with a 1.2 mm diameter and a 2 to 10 mm length, contains 2.36% by weight of cobalt and 9.33% by weight of molybdenum; the matrix consists of transition alumina. The specific surface is 210 square meters per gram and the pore volume is 0.48/cm$^3$/g.

The catalyst is then subjected to a presulfuration treatment. A hydrogen sulfide-hydrogen mixture in volume proportions 3:97 is injected at a rate of 10 1/h. The rate of temperature rise is 1° C./minute and the final stage (350° C.) is 2 hours.

The hydrogen flow being maintained by itself, a heavy condensate of liquefied gas, whose characteristics are indicated in table 1, and hydrogen are finally made to pass over the catalyst, in upward flow, under the following conditions:

| | |
|---|---|
| batch flow: | 500 cm$^3$/h |
| temperature: | 320° C. |
| total pressure: | 30 absolute bars |
| hydrogen flow: | 100 liters/liter of batch, or 50 liters/hour. |

The condensate and hydrogen are allowed to pass for 500 hours. The results of analyses of mercury and arsenic in the product at the end of 20, 50, 100, 200 and 500 hours are summarized in table III.

It is seen that this catalyst exhibits a very low efficiency for holding mercury; on the other hand, it exhibits a good efficiency for holding arsenic.

Example 2 (Comparison)

In this example, a collection mass consisting of a copper sulfide, deposited on an alumina support as described in U.S. Pat. No. 4,094,777 of the applicant, is prepared.

The mass contains 12% by weight of copper and 6% by weight of sulfur in the form of sulfide. The matrix consists of transition alumina. The specific surface is 70 $m^2/g$ and the pore volume is 0.4 $cm^3/g$.

100 $cm^3$ of this mass is then charged in a reactor identical with that described in example 1. A heavy condensate of liquefied gas, identical with that used in example 1 (cf. table I), is then made to pass over the mass, in upward flow, under the following conditions:

| | |
|---|---|
| batch flow: | 500 $cm^3/h$ |
| total pressure: | 30 absolute bars |
| temperature: | 40° C. |
| hydrogen flow: | 100 liters per liter of batch, or 50 liters per hour. |

The condensate is allowed to pass for 500 hours. The results of analyses of mercury and arsenic in the product at the end of 20, 50, 100, 200 and 500 hours are summarized in table III.

It is seen that the collection mass does not exhibit efficiency for holding arsenic. On the other hand, it exhibits a transitory efficiency for holding mercury, but the latter drops very quickly with time.

Example 3 (Comparison)

The experiment of example 2 is repeated, but eliminating the flow of hydrogen.

The results indicated in table III show that the performances are not improved.

Example 4 (According to the Invention)

In a first reactor, 250 $cm^3$ of catalyst HR 306 of example 1 is charged then pretreated according to the technique and the pretreatment described in said example.

In a second reactor, 100 $cm^3$ of the collection mass of example 2 is charged according to the technique described in said example.

The same heavy condensate of liquefied gas as in example 1 is then made to pass in upward flow under hydrogen gradually over the catalyst then over the collection mass. The operating conditions are as follows:

| | |
|---|---|
| batch flow: | 500 $cm^3/h$ |
| catalyst HR 306: | 250 $cm^3$ |
| temperature: | 320° C. |
| total pressure: | 30 absolute bars |
| hydrogen flow: | 100 liters per liter of batch, or 50 liters per hour. |
| collection mass in copper sulfide: | 100 $cm^3$ |
| temperature: | 40° C. |
| total pressure: | 30 absolute bars |
| hydrogen flow: | 100 liters per liter of batch, or 50 liters per hour. |

The condensate is allowed to pass for 1000 hours. The results of analyses of mercury in the product at the end of 50, 100, 200, 500 and 1000 hours are summarized in table IV below.

It is seen, unexpectedly, that the association of catalyst HR 306 and a collection mass makes it possible to obtain a high rate of dearsenification and demercurization of the condensate.

The analysis of catalyst HR 306 shows that more than 90% of the arsenic fixed is present in said catalyst; the concentration of mercury, on the other hand, is less than 20 ppm by weight. The analysis of the demercurization mass shows that it contains almost 100% of the mercury fixed and less than 10% of the arsenic fixed.

These metals essentially are present in the first 50 $cm^3$ of the bed. It is therefore possible to expect a very long life.

Example 5, According to the Invention

To demonstrate the thioresistance of the catalytic system, 0.5% by weight of sulfur in the form of thiophene is added to the batch treated in example 1.

The operating conditions are identical, with the exception of the operating temperature of catalyst HR 306, brought to 340° C. and the hydrogen flow, brought to 200 liters/liter of batch, or 100 liters/hour.

The performance data, summarized in table III, is identical with the information of the analyses.

Example 6, According to the Invention

The experiment described in example 4 is reproduced. The reactor containing 100 $cm^3$ of collection mass in copper sulfide is now charged with:

100 $cm^3$ of said mass and

50 $cm^3$ of the demercurization mass consisting of 13% by weight of sulfur on activated carbon, of CALGON HGR type, prepared according to the teaching of U.S. Pat. No. 3,194,629.

The other operating conditions remain strictly identical and the test is limited to 500 hours.

The experiment results reproduced in table III show that the addition of the demercurization mass to the activated carbon makes possible a slight improvement of the performance data in demercurization. The performances in dearsenification, on the other hand, remain unchanged.

Example 7, According to the Invention

The first reactor used in example 3 is now charged with 200 $cm^3$ of catalyst HMC 841, marketed by PROCATALYSE.

This catalyst consisting of balls of 1.5 to 3 mm diameters contains 1.96% by weight of nickel and 8% by weight of molybdenum; the matrix consists of transition alumina. The specific surface is 140 $m^2/g$ and the pore volume is 0.89 $cm^3/g$. Catalyst HMC 841 has been presulfurated before charging (ex situ sulfuration) according to the SULFICAT (R) process marketed by the EURECAT company; its sulfur content is 4.8% by weight.

The second reactor is charged with 200 $cm^3$ of a demercurization mass containing 8% by weight of sulfur, 14.5% by weight of copper and 0.2% by weight of silver, prepared according to the teaching of U.S. Pat. No. 4,094,777 of the applicant, then presulfurated by putting into contact with an organic polysulfide according to the teaching of French patent 87-07442 of the applicant.

The characteristics of the new treated batch (heavy condensate of liquefied gas) are indicated in table II; the duration of the test is 1000 hours.

| | |
|---|---|
| batch flow: | 0.6 liter/hour |
| catalyst HMC 841: | 200 $cm^3$ |
| temperature: | 390° C. |
| pressure: | 40 bars |
| hydrogen flow: | 150 liters per liter of batch, or 90 liters/hour |
| collection mass in copper and silver sulfides: | 200 $cm^3$ |
| temperature: | 100° C. |
| pressure: | 40 bars |

The results of analysis of mercury and arsenic in the product at the end of 20, 50, 100, 200, 500 and 1000 hours are summarized in table III. It is seen that the dearsenification of the batch is always greater than 99% and that the demercurization is always greater than 98.8%.

Further, the analysis of the purified liquid effluent, at the end of 500 hours of testing, shows that it contains only 60 ppm (by weight) of sulfur and 33 ppm (by weight) of nitrogen. The hydrodesulfuration rate and the hydrodenitrification rate are therefore respectively 95.4 and 24%. Further, the effluent contains only 28% of aromatic compounds (relative to 41% in the fresh batch), which demonstrates, besides the activity in dearsenification and in demercurization, the additional properties in hydrodesulfuration, hydrodenitrification and hydrogenation of the aromatic compounds of the whole (catalyst+demercurization mass) according to the invention.

Example 8, According to the Invention

The treated batch is still that described in table II.

Now, a single reactor, with a 4 cm diameter, is used, containing from the input to the output:

0.5 liter of catalyst HMC 841, presulfurated off-site as in example 7, 0.2 liter of the mass in copper and silver sulfides used in example 7.

The operating temperature is equal to 220° C., the operating pressure equal to 50 bars (absolute) and the flow is 200 liters per liter of batch, or 120 liters per hour.

The batch flow is 0.6 liter per hour.

The analysis of hydrogen, recovered at the output after separation (high-pressure separator) of the purified batch, shows that it contains hydrogen sulfide, formed by hydrodesulfuration of said batch in the presence of catalyst HMC 841.

The test lasts 500 hours and the performance data obtained is summarized in table III.

It is seen that the use of two catalysts in a single reactor leads to a good efficiency for the demercurization and the dearsenification of the batch.

TABLE I

| Characteristics of the batch of examples 1 to 6 | | |
|---|---|---|
| Density | 0.754 | $g/cm^3$ |
| S (ppm by weight) | 150 | |
| Hg (ppm by weight) | 0.6 | |
| As (ppm by weight) | 0.5 | |
| | Pi | 22 |
| Distillation | 5% | 35 |
| ASTM D 86 | 50% | 129 |
| (°C.) | 95 | 330 |
| | mp | 475 |

TABLE II

| Characteristics of the batch of examples 7 and 8 | | |
|---|---|---|
| Density | 0.769 | $g/cm^3$ |
| S (ppm by weight) | 1300 | |
| N (ppm by weight) | 45 | |
| Hg (ppm by weight) | 1.1 | |
| As (ppm by weight) | 1.5 | |
| Fe (ppm by weight) | 1 | |
| Aromatic compounds (% by weight) | 41 | |
| | Pi | 30 |
| Distillation | 5% | 42 |
| ASTM D 86 | 50% | 127 |
| (°C.) | 95 | 362 |
| | mp | 497 |

TABLE III

| | As | | Hg | | As | | Hg | | As | | Hg | |
|---|---|---|---|---|---|---|---|---|---|---|---|---|
| | C % | ppb | C % | ppb | C % | ppb | C % | ppb | C % | ppb | C % | ppb |
| | Test Period | | | | | | | | | | | |
| Example No. | 20 h | | | | 50 h | | | | 100 h | | | |
| 1 | 99 | 5 | 20 | 480 | 99 | 5 | 15 | 510 | 98 | 10 | 14 | 517 |
| 2 | 10 | 450 | 97 | 18 | 8 | 460 | 95.5 | 28 | 7 | 465 | 88 | 71.5 |
| 3 | 9 | 455 | 96 | 24 | 9 | 455 | 96 | 24 | 8 | 460 | 87 | 78 |
| 4 | 99 | 5 | 97 | 18 | 98.5 | 7.5 | 98 | 12 | 99 | 5 | 97 | 17 |
| 5 | 99 | 5 | 97.5 | 14 | 99 | 5 | 98 | 11 | 98.5 | 7.5 | 97.5 | 15 |
| 6 | 98 | 10 | 98.2 | 11 | 99 | 5 | 98.5 | 9 | 99 | 5 | 98 | 12 |
| 7 | 99.5 | 7.5 | 98.9 | 12 | 99.3 | 10 | 99 | 11 | 99.4 | 9 | 99 | 11 |
| 8 | 99.3 | 10 | 98.5 | 16 | 99 | 15 | 99.5 | 6 | 99.1 | 13 | 99.4 | 7 |

| | As | | Hg | | As | | Hg | | As | | Hg | |
|---|---|---|---|---|---|---|---|---|---|---|---|---|
| | C % | ppb | C % | ppb | C % | ppb | C % | ppb | C % | ppb | C % | ppb |
| | Test Period | | | | | | | | | | | |
| Example No. | 200 h | | | | 500 h | | | | 1000 h | | | |
| 1 | 99 | 5 | 12 | 530 | 99 | 5 | 10 | 540 | | | | |
| 2 | 8 | 460 | 53 | 282 | 5 | 475 | 31 | 415 | | | | |
| 3 | 7 | 465 | 54 | 277 | 6 | 470 | 30 | 420 | | | | |
| 4 | 98 | 10 | 98 | 11 | 99 | 5 | 97.5 | 15 | 98.5 | 7.5 | 98 | 12 |
| 5 | 98 | 10 | 97.5 | 14 | 99 | 5 | 98 | 12 | 99 | 5 | 97.5 | 14 |
| 6 | 98.5 | 8 | 98.3 | 10 | 99 | 5 | 98.8 | 7.2 | | | | |
| 7 | 99.3 | 11 | 99.1 | 10 | 99.3 | 10 | 98.9 | 12 | 99.2 | 12 | 98.8 | 13 |

TABLE III-continued

| | | | | | | | | |
|---|---|---|---|---|---|---|---|---|
| 8 | 99 | 15 | 99.3 | 8 | 98.9 | 16 | 99.3 | 8 |

Key:
C % = rate of fixation, in percent by weight, of mercury and arsenic in the whole consisting of the catalyst and the demercurization mass.
ppb = residual concentration of arsenic and mercury, expressed in micrograms ($10^{-6}$ gram) per kilogram (or in milligrams per metric ton).

We claim:

1. A process of eliminating mercury from a charge of hydrocarbons containing 0.005–3% by weight of (a) sulfur, and (b) mercury compounds containing at least two carbon atoms, comprising:

reacting a mixture consisting essentially of hydrogen and said charge in the presence of a catalyst so as to activate and convert said mercury compounds to material which will react with a mercury collection mass, said catalyst containing 0.01–5% by weight of at least one metal M selected from the group consisting of nickel and cobalt; 5–25% by weight of at least one metal N selected from the group consisting of molybdenum and tungsten, wherein the atomic ratio of M/N is 0.3:1 to 0.7:1 and at least one of the metal M and the metal N is in sulfurized form to an extent of at least 50% of the total quantity; and, optionally, at least one active phase support based on at least one porous mineral matrix, said catalyst being in a first reactor, and passing effluent from said first reactor to a second reactor containing said mercury collection mass containing a sulfide of at least one metal P selected from the group consisting of copper, iron, and silver or sulfur, and an active phase support, wherein the process is conducted with:

an operating pressure of 1–50 absolute bars, a hydrogen flow of 1–1000 liters of gaseous hydrogen at STP per liter of liquid charge, an hourly volumetric rate, expressed by volumes of liquid charge, of 0.1–30 volumes per volume of catalyst and 0.1–30 volumes per volume of mercury collection mass, an operating temperature of the catalyst of 180°–450° C., and an operating temperature of the mercury collection mass of 0°–400° C.

2. A process according to claim 1, wherein the charge further comprises at least one of hydrogen sulfide and a sulfurated organic compound.

3. A process according to claim 1, wherein, besides metals M and N, the catalyst contains an active phase support of a porous mineral matrix comprising at least one of the elements from the group consisting of alumina, silica, silica-alumina, magnesia, zirconia, titanium oxide, clays, aluminous cements, aluminates, zeolitic, and synthetic or natural aluminosilicates.

4. A process according to claim 1, wherein the mercury collection mass contains from 1–40% of sulfur relative to its total weight and at least one support selected from the group consisting of alumina, silica-aluminas, silica, titanium oxide, zirconia, zeolites, activated carbon, clays, and aluminous cements.

5. A process according to claim 4, wherein the mercury collection mass also contains from 0.1–20% by weight of at least one metal P selected from the group consisting of copper, iron, and silver, and wherein said metal P is at least partially in the form of sulfide.

6. A process according to claim 1, wherein hydrogen-rich gas is separated from effluent from the second reactor and then at least partially recycled to the head of the first reactor.

7. A process according to claim 1, wherein prior to the reacting with the charge of hydrocarbons, the catalyst is pretreated at a temperature of from 50°–500° C. by a gas mixture containing at least one compound selected from the group consisting of hydrogen, hydrogen sulfide, and an organic sulfur compound.

8. A process according to claim 1, wherein the charge comprised of hydrocarbons is at least partially liquid at room temperature and ambient pressure and contains from $10^{-3}$ to 10 mg of mercury per kg of batch.

9. A process according to claim 1, wherein the treated charges are heavy batches or effluents of processes of thermal and/or catalytic conversion.

10. A process according to claim 1, wherein the treated charges are gas condensates.

11. A process according to claim 8, wherein the charge comprises $10^{-2}$ to 2 mg of arsenic per kg of batch.

12. A process according to claim 1, wherein the hydrocarbon charge contains 0.02–2% by weight of sulfur.

13. A process according to claim 12, wherein the charge contains from $10^{-3}$ to 10 mg of mercury per kg of charge.

14. A process according to claim 13, wherein the charge comprises $10^{-2}$ mg of arsenic per kg charge.

15. A process according to claim 1, wherein the charge comprises $10^{-2}$ to 2 mg of arsenic per kg charge.

16. A process according to claim 14, wherein the charge is at least partially liquid at room temperature and ambient pressure.

17. A process according to claim 1, wherein, besides mercury and sulfur, the charge contains arsenic, and the arsenic and mercury are eliminated by interaction with the catalyst and mercury collection mass.

18. A process according to claim 17, wherein with the elimination of arsenic and mercury, the charge is also partially hydrodesulfurated, hydrodenitrified, or hydrogenated.

19. A process according to claim 1, wherein the operating temperature of the reaction with the hydrogen, charge, and catalyst is 260°–450° C.

20. A process according to claim 1, wherein the operating temperature of the reaction with the hydrogen, charge, and catalyst is 260°–390° C.

21. A process according to claim 1, wherein the hydrogen flow is 30–300 liters of gaseous hydrogen at STP per liter of liquid charge.

22. A process according to claim 19, wherein the hydrogen flow is 30–200 liters of gaseous hydrogen at STP per liter of liquid charge.

23. A process according to claim 20, wherein the hydrogen flow is 30–200 liters of gaseous hydrogen at STP per liter of liquid charge.

24. A process according to claim 1, wherein said charge contains no arsenic.

* * * * *